United States Patent [19]

Van Dyke et al.

[11] 4,132,327

[45] Jan. 2, 1979

[54] HATCH COVER OPENING AND CLOSING ASSEMBLY

[75] Inventors: Ronald D. Van Dyke, Florissant; James C. Hammonds; Patricia S. Stoller, both of St. Charles, all of Mo.

[73] Assignee: ACF Industries, Inc., New York, N.Y.

[21] Appl. No.: 901,339

[22] Filed: May 1, 1978

[51] Int. Cl.[2] ..... B65D 45/00

[52] U.S. Cl. ..... 220/244; 220/246; 220/247; 220/250; 220/251; 220/323; 105/377

[58] Field of Search ..... 220/243, 244, 246, 247, 220/249–251, 318, 323; 105/377

[56] References Cited

U.S. PATENT DOCUMENTS

| | | | |
|---|---|---|---|
| 1,784,198 | 12/1930 | Persson | 220/246 |
| 2,260,752 | 10/1941 | Marasso | 220/244 |
| 3,307,498 | 3/1967 | Stevens | 137/377 |
| 3,394,834 | 7/1968 | Cighiano | 220/251 |

*Primary Examiner*—George T. Hall
*Attorney, Agent, or Firm*—Henry W. Cummings

[57] ABSTRACT

In accordance with the present invention a hatch cover opening and closing assembly is provided including a locking handle having a yoke pivotably mounted about a vertically extending shaft located in the center portion of the cover. The shaft extends downwardly through a guide which depends from the cover. The guide includes at least one generally vertical indexing slot. Below the cover a laterally extending pin and a plurality of radially extending locking arms are attached to the shaft. A plurality of locking lugs are mounted on the internal surface of the coaming. The shaft is rotatable by the handle to move the locking arms into and out of engagement with the locking lugs. However the pin must be located within the indexing slot to move the locking arms vertically into engagement with the locking lugs. When the shaft is rotated so that the pin is located out of the slot, but in engagement with the guide, the handle may be used to pivot the cover about a hinge into open position. Preferably the locking arms comprise leaf springs when in engaged position with the locking lugs. The yoke on the handle is preferably formed in the shape of an arcuate cam surface whereby in closed position the yoke assumes an overcenter position on the cover, urging a seal on the cover into engagement with a lip on the coaming, against the bias of the leaf spring locking arms.

19 Claims, 4 Drawing Figures

(1)
2
30
28
24
73a
72
22
26
12
16
11
52
54
36
14
18
45
46
58
10

83
86
82
76
80
78
84
75
74
52
54
56
88
36
68a
73
73b
62
42
73a
38
32
A1
20
68
18
67
64
44
40
34
60
36
56
58
48
46
50

HATCH COVER OPENING AND CLOSING ASSEMBLY

BACKGROUND OF THE INVENTION

In U.S. Pat. No. 3,821,935 granted July 2, 1974 a hatch cover is provided with a handwheel having a threaded shaft extending through the hatch cover. A hub is threaded onto the shaft having a plurality of radially extending locking arms which engage fixed lugs on the hatch coaming. A guide plate depending from the cover includes a cam slot which receives a follower extending from the hub. Rotation of the handwheel causes rotation and vertical movement of the locking arms into engagement with the lugs on the hatch coaming. The later part of this movement causes a seal on the cover to be urged into engagement with a lip on the coaming. To open the cover the handwheel is rotated in the opposite direction until the locking arms clear the locking lugs. The cover is then pivoted about a hinge to the open position.

This construction is disadvantageous because of the difficulty of obtaining a satisfactory seal between the threaded shaft and the cover, the large number of turns of the handwheel, at least about 13, to move the locking arms between open and closed position, and because of cost. Furthermore the internal friction between the threaded shaft and hub may result in some contamination of lubricant and/or ground metal.

Also the force urging the seal into engagement with the coaming is dependent upon the number of turns applied by the operator. If an insufficient number of turns is applied by the operator, the cover may not remain properly seated in transit.

SUMMARY OF THE INVENTION

In accordance with the present invention a hatch cover opening and closing assembly is provided including a locking handle having an inner end pivotably mounted about a vertically extending shaft located in the center portion of the cover. The shaft extends downwardly through the cover and through a guide which depends from the cover. The guide includes at least one generally vertical indexing slot. A laterally extending pin is attached to the shaft below the cover. Furthermore a plurality of radially extending locking arms are attached to the shaft. A plurality of locking lugs are mounted on the internal surface of the coaming. The shaft is rotatable by the handle to move the locking arms into and out of engagement with the locking lugs. The shaft is movable vertically within the guide. The pin must be located within the indexing slot to move the locking arms vertically into the closed position, engaging the locking lugs. The shaft is rotatable to move the pin out of the slot, but in engagement with the guide. The handle may be used to pivot the cover about a hinge into open position. Preferably the locking arms comprise leaf springs when in engaged position with the locking lugs. The handle includes a yoke at its inner end formed in the shape of an arcuate cam surface, whereby in closed position the handle assumes an overcenter position on the cover, urging the cover seal into engagement with a lip on the coaming against the bias of the leaf spring locking arms.

THE DRAWINGS

DESCRIPTION OF PREFERRED EMBODIMENTS

Figures 1, 2:
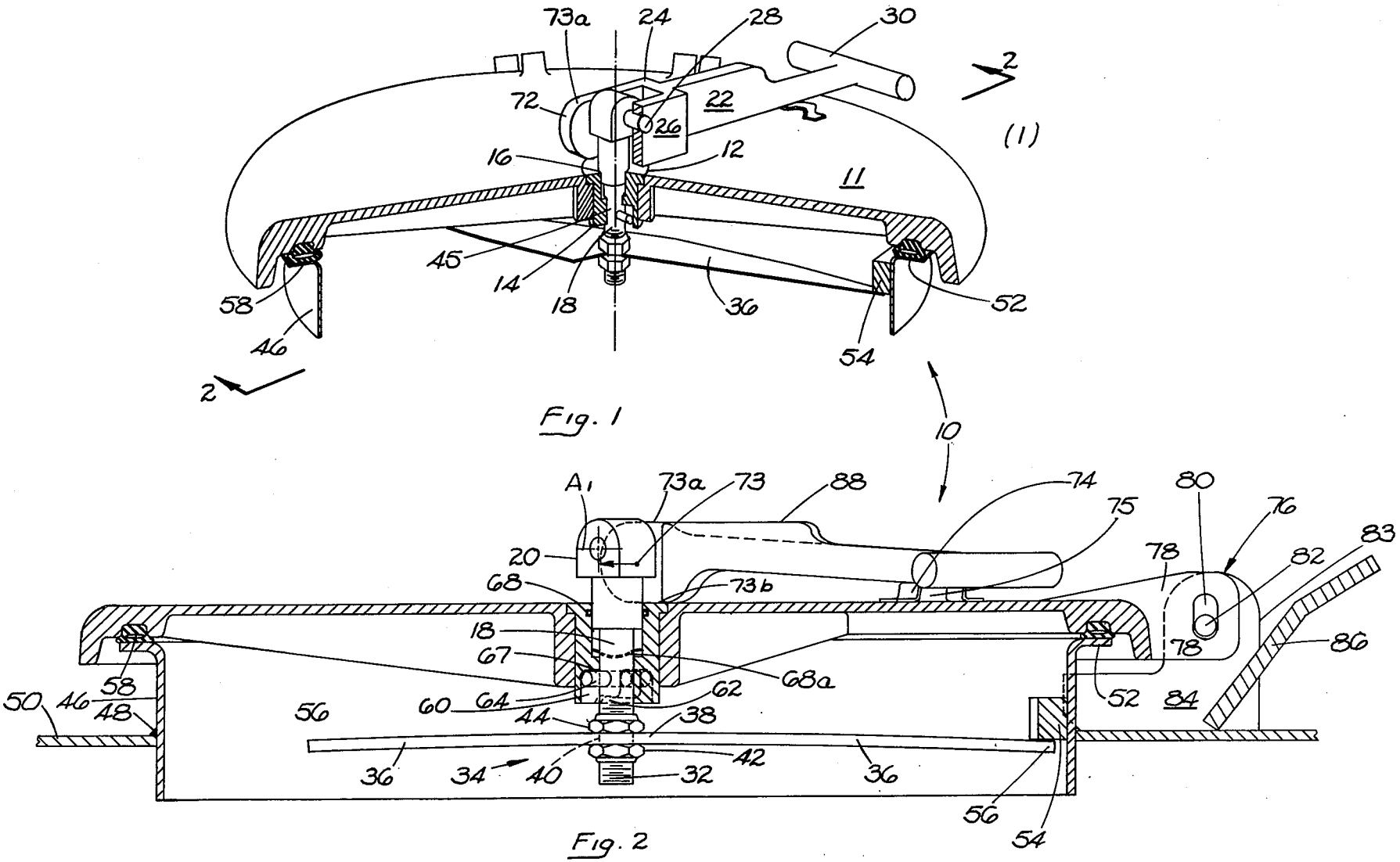
FIG. 1 is a perspective view of the hatch cover assembly of the present invention with parts broken away illustrating the handle member in closed position.
FIG. 2 is a vertical sectional view looking in the direction of the arrows along the line 2—2 of FIG. 1 illustrating the handle in the closed position.

In the drawings a hatch cover opening and closing assembly 10 includes a cover 11 made of suitable material such as metal or fiberglass. The cover 11 includes an opening 12 in the center thereof. A cylindrical guide member 14 is inserted into this opening and is rigidly attached. Guide member 14 includes a center opening 16 through which a vertically extending shaft 18 extends. Shaft 18 is movable vertically within guide 14 and includes a head portion 20. A wear ring 68 having a center opening for shaft 18 is formed integral with guide 14. Alternatively, wear ring 68 is welded to guide 14.

A handle 22 includes a fork portion 24 having spaced arms 26. A pin 28 passes through arms 26 and head 20 to hold the handle in place, pivotable about head 20. Handle 22 further includes a gripping portion 30 extending transverse to the axis of handle 22.

Figure 3:
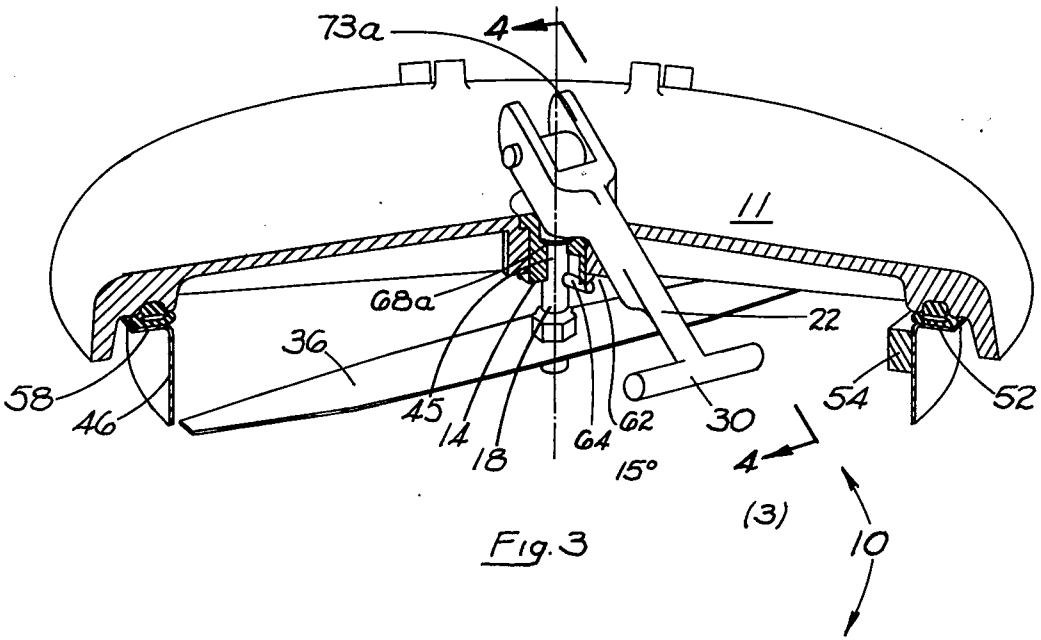
FIG. 3 is a perspective view of the hatch cover with parts broken away with the handle in position to lift the cover.

Shaft 18 is threaded at the lower portion thereof 32. A locking member indicated generally at 34 includes a plurality of radially extending locking arms 36 extending into a center body portion 38 having an opening 40 which is located on threaded shaft portion 32. Locking member body portion 38 is maintained in place on threaded shaft portion 32 by means of a pair of threaded nuts 42 and 44. Shaft portion 32 includes a flat portion 45 (FIG. 3) to index locking member 34 into proper radial position on shaft portion 32.

Figure 4:
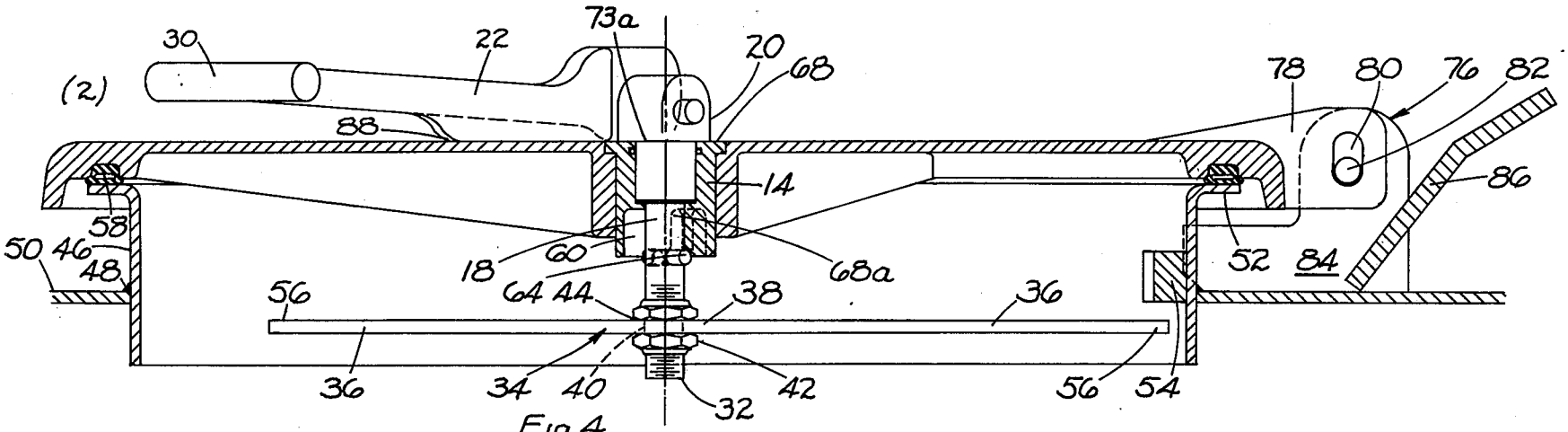
FIG. 4 is a vertical sectional view looking in the direction of the arrows along the line 4—4 in FIG. 3 showing the handle rotated 180° from FIG. 1 with the locking arms below the locking lugs in the coaming.

A hatch coaming 46 is welded at 48 to a car roof 50. Coaming 46 includes an outwardly turned lip 52. An elastomeric seal 58 attached to cover 11 with a suitable bonding agent engages lip 52 when the cover is in the closed position. A plurality of locking lugs 54 are located about the internal circumference of coaming 46 (FIG. 2). In closed position the end portion 56 of locking arms 36 engage the lower surface of locking lugs 54. Shaft guide 14 includes a pair of slots 60 and 62 as shown in FIGS. 4 and 5. A pin 64 is rigidly attached to shaft 18, for example, by press fit or welding. Handle 22 may be utilized to rotate shaft 18 to align pin 64 with an indexing slot 60 and a lifting slot 62. Indexing slot 60 includes an enlarged lower portion 66 and a generally vertical upper portion 67. A wave spring **68*a* engages and biases shaft 18 upwardly, including pin 64 within lifting slot 62**.

Shaft 18 is rotatable by handle 22 to move locking member 34 including locking arms 36 circumferentially relative to locking lugs 54. The location of slot 60 in guide 14 corresponds to the position where end portion 56 of locking arms 36 align with locking lugs 54 on the coaming. Thus after shaft 18 is rotated to align locking arm ends 56 with lugs 54, shaft 18 is moved vertically upwards with slot 60. As shown in FIG. 2, locking member 34 is located vertically on threaded portion 32 relative to locking lugs 54 such that when shaft 18 is moved vertically sufficiently for pin 64 to engage upper slot portion 67, locking arms 36 are bowed or displaced downwardly, and as much, function as leaf springs. For example, locking arms may be 9¾ inches long and be displaced downwardly about one-fourth (¼) inch to function as leaf springs.

Fork arms 26 are provided with arcuate portions 72 spaced outwardly from the horizontal axis $A_1$ of pin 28. Further arcuate portions 72 are formed on a radius having a center 73 spaced below the center line of pin 28. For example, arcuate portion 72 may be formed on 1 5/16 inch radius formed from a center spaced one-fourth (¼) inch below the center line of pin 28. With this arrangement when shaft 18 is in the fully extended position with pin 64 in the upper portion 67 of slot 60, and handle 22 is in the overcenter position shown in FIGS. 1 and 2, cover 11 and seal 58 are urged downwardly against lip 52, and locking member 34 is pulled upwardly, with locking arms 36 bowed and/or displaced downwardly in engagement with lugs 54.

A conventional hinge is indicated generally at 76 including a pair of legs 78 attached to the cover 11. Legs 78 extending outwardly from cover 11 have openings therein 80 which receive a pin 82. Pin 82 also extends through arms 83 of a bracket 84 which is welded to the car roof 50. An open position stop 86 is welded to bracket 84. A strap 74 is welded to the external surface of cover 11 adjacent the fully closed position of handle 22 including a slot 75 to receive a car seal (not shown).

Handle 22 further includes an open position stop 88 which engages the cover 11 after handle 22 is rotated 180° to the open position, which insures that pin 64 extends sufficiently far out of slot 60 to rotate into slot 62 (FIG. 4).

The position of the cover in closed position is shown in solid lines in FIGS. 1 and 2, and indicated at (1) in FIG. 1. To open the cover, the handle 22 is first grasped at portion 30 and is pivoted upwardly and outwardly about 180° to the position indicated at (2) shown in FIG. 4. In position (2) surface **73*a* engages wear portion 68, allowing shaft 18 to drop with head 20 in engagement with wear portion 68. This allows shaft 18 and pin 64 to drop vertically within slot 60. At the same time locking arms 36 drop vertically relative to lugs 54. Handle 22 is next rotated counterclockwise from the position shown in FIG. 4 to the position (3) shown in FIG. 3 where handle 22 is approximately 15° past the center line of hinge 76. Pin 64 engages slot 62 in guide 14. Pin 62 is biased into this position by wave spring 68*a*. When pin 64 is within slot 62** it is adapted to support the cover. The cover thus can be pivoted 180° to the open position. The lading may then be loaded into the car and/or the lading unloaded through outlets located at the bottom of the car (not shown).

To close the cover the reverse takes place. The cover is rotated 180° to the closed position. The operator rotates handle 22 clockwise in FIG. 3 to the position (2) shown in FIG. 4, to move pin 64 below slot 60, and locking arms 36 to a position below lugs 54.

Handle 22 is then pivoted 180° to the position shown in FIGS. 1 and 2 at (1) and into an overcenter position with flat portion 73 of fork arms 26 engaging wear portion 28. In assuming this overcenter position, shaft head 20, shaft 18 and pin 64 are moved vertically within slot 60 to the upper portion 67. Furthermore, locking arms 36 are moved vertically into the position shown in solid lines in FIG. 2 engaging locking lug 54 with bending, and vertical displacement. Seal 58 is thus urged into engagement with coaming lip 52. A railroad seal may be inserted below strap 74 through slot 75 and around handle 22.

It is convenient that the radial distance between positions (2) and (3) shown be about 30°. It further is preferred that position (3) corresponds to a position approximately 15° beyond hinge 76 to make it easier to lift the cover into the open position.

It will be apparent to those skilled in the art that modifications of the construction shown and described are possible. For example, slot 62 need not be provided in order to lift the cover with handle 22, and wave spring **68*a* is not essential. Pin 64 need only engage the lower surface of guide 14 and/or cover 11** to pivot the cover to open position.

The particular arrangement for maintaining shaft 18 in the upper, closed position may vary. For example, a locking member separate from handle 22 may be provided to maintain shaft 32 in the upper, closed position. Furthermore, if handle 22 is used to maintain the shaft in the upper closed position, a different overcenter arrangement may be utilized. Also the cover may be contoured to provide guide portion 14. Locking member 34 may be held in place on shaft 32 by a different arrangement.

It will be apparent from the foregoing examples that many modifications of the present invention are possible. The invention is thus limited only by the claims included hereinafter.

What is claimed is:

1. A hatch cover opening and closing assembly comprising: a hatch cover pivotably mounted relative to a hatch coaming; a locking handle having an inner end pivotably mounted about a vertically extending shaft located in the center portion of said cover; said shaft extending downwardly through said cover and through a guide depending from said cover; said guide including at least one generally vertical indexing slot; a laterally extending shaft pin attached to said shaft; a plurality of radially extending locking arms attached to said shaft; a plurality of locking lugs mounted on the internal surface of said hatch coaming; said shaft being rotatable by the handle to move said locking arms radially relative to said locking lugs, and to move said shaft pin into said indexing slot; said shaft further being movable vertically to move said locking arms into and out of engagement with said locking lugs.

2. A hatch cover opening and closing assembly according to claim 1 wherein said shaft is rotatable to move said shaft pin out of said slot, and into engagement with said guide, whereby the handle may be used to pivot the cover about a hinge into the open position.

3. A hatch cover opening and closing assembly according to claim 1 wherein said locking arms comprise leaf springs which in engaged position with the locking lugs urge a seal depending from the cover into engagement with a lip on said hatch coaming.

4. A hatch cover opening and closing assembly according to claim 3 wherein the inner end of said handle is formed in the shape of an arcuate cam surface, whereby in closed position said handle assumes an overcenter position on the cover, urging said cover seal into engagement with the coaming lip, against the bias of said leaf spring locking arms.

5. A hatch cover opening and closing assembly according to claim 4 wherein said inner end is forked and is connected to said shaft with a handle pin.

6. A hatch cover opening and closing assembly according to claim 4 wherein said shaft includes a head of larger diameter than the opening in said guide and wherein said handle pin passes through said head.

7. A hatch cover opening and closing assembly according to claim 6 wherein said head is spaced above the upper surface of said guide when said handle is placed in said overcenter position.

8. A hatch cover opening and closing assembly according to claim 7 wherein said inner end includes an arcuate portion which is laterally from a horizontal center line of said handle pin in said overcenter position.

9. A hatch cover opening and closing assembly according to claim 3 wherein a second slot is provided in said guide, and in which said shaft pin engages when said cover is lifted between closed and open positions.

10. A hatch cover opening and closing assembly according to claim 9 wherein a wave spring is provided in said guide which urges said shaft pin into engagement with said second slot.

11. A hatch cover opening and closing assembly according to claim 7 wherein said handle includes a handle open position stop surface which rests upon said cover when said handle is rotated 180° from a handle closed to a handle open position which insures that said shaft pin can be rotated within said indexing slot in said handle open position.

12. A hatch cover opening and closing assembly comprising: a hatch cover pivotably mounted relative to a hatch coaming; a locking handle having an inner end pivotably mounted about a vertically extending shaft located in the center portion of said cover; said shaft extending downwardly through said cover and through a guide depending from said cover; said guide including at least one generally vertical indexing slot; a laterally extending shaft pin attached to said shaft; a plurality of radially extending locking arms attached to said shaft; a plurality of locking lugs mounted on the internal surface of said hatch coaming; said shaft being rotatable by the handle to move said locking arms radially relative to said locking lugs, and to move said shaft pin into said indexing slot; said shaft further being movable vertically to move said locking arms into and out of engagement with said locking lugs; said shaft being rotatable to move said shaft pin out of said slot, and into engagement with said guide, whereby the handle may be used to pivot the cover about a hinge into the open position.

13. A hatch cover opening and closing assembly comprising: a hatch cover pivotably mounted relative to a hatch coaming; a locking handle having an inner end pivotably mounted about a vertically extending shaft located in the center portion of said cover; said shaft extending downwardly through said cover and through a guide depending from said cover; said guide including at least one generally vertical indexing slot; a laterally extending shaft pin attached to said shaft; a plurality of radially extending locking arms attached to said shaft; a plurality of locking lugs mounted on the internal surface of said hatch coaming; said shaft being rotatable by the handle to move said locking arms radially relative to said locking lugs, and to move said shaft pin into said indexing slot; said shaft further being movable vertically to move said locking arms into and out of engagement with said locking lugs; said shaft being rotatable to move said shaft pin out of said slot, and into engagement with said guide; whereby the handle may be used to pivot the cover about a hinge into the open position; said locking arms comprising leaf springs which in engaged position with the locking lugs urge a seal depending from the cover into engagement with a lip on said hatch coaming.

14. A hatch cover opening and closing assembly comprising: a hatch cover pivotably mounted relative to a hatch coaming; a locking handle having an inner end pivotably mounted about a vertically extending shaft located in the center portion of said cover; said shaft extending downwardly through said cover and through a guide depending from said cover; said guide including at least one generally vertical indexing slot; a laterally extending shaft pin attached to said shaft; a plurality of radially extending locking arms attached to said shaft; a plurality of locking lugs mounted on the internal surface of said hatch coaming; said shaft being rotatable by the handle to move said locking arms radially relative to said locking lugs, and to move said shaft pin into said indexing slot; said shaft further being movable vertically to move said locking arms into and out of engagement with said locking lugs; said shaft being rotatable to move said shaft pin out of said slot, and into engagement with said guide, whereby the handle may be used to pivot the cover about a hinge into the open position; and overcenter means located on the external surface of said cover movable between a first position maintaining said shaft in its upper position and said locking arms in engagement with said locking lugs, and a second release position allowing said shaft to descend and allowing said locking arms to disengage from said locking lugs.

15. A hatch cover opening and closing assembly according to claim 14 wherein said overcenter means is located at the inner end of said handle in the shape of an arcuate cam surface and whereby in closed position said handle assumes an overcenter position on the cover, urging said cover seal into engagement with the coaming lip.

16. A hatch cover opening and closing assembly according to claim 15 wherein said inner end is forked and is connected to said shaft with a handle pin.

17. A hatch cover opening and closing assembly according to claim 16 wherein said shaft includes a head of larger diameter than the opening in said guide and wherein said handle pin passes through said head.

18. A hatch cover opening and closing assembly according to claim 17 wherein said head is spaced above the upper surface of said guide when said handle is placed in said overcenter position.

19. A hatch cover opening and closing assembly according to claim 18 wherein said inner end includes an arcuate portion which is laterally spaced from a horizontal center line of said pin in said overcenter position.

* * * * *

UNITED STATES PATENT AND TRADEMARK OFFICE

CERTIFICATE OF CORRECTION

PATENT NO. : 4,132,327

DATED : January 2, 1979

INVENTOR(S) : R. D. Van Dyke, J. C. Hammonds, P. S. Stoller

It is certified that error appears in the above-identified patent and that said Letters Patent are hereby corrected as shown below:

Col. 5, line 14 (claim 8), change "from a" to --spaced from the--.

Signed and Sealed this

*Fifth* Day of *June 1979*

[SEAL]

*Attest:*

RUTH C. MASON
*Attesting Officer*

DONALD W. BANNER
*Commissioner of Patents and Trademarks*